United States Patent [19]

Allmendinger et al.

[11] 4,415,369

[45] Nov. 15, 1983

[54] INJECTION TANK FOR CLEANING BOILERS AND HEAT EXCHANGERS

[76] Inventors: James M. Allmendinger, 9263 Panama Ave., Ypsilanti, Mich. 48197; James O. Thornton, 20555 Lindley Rd., Chelsea, Mich. 48118

[21] Appl. No.: 359,112

[22] Filed: Mar. 17, 1982

[51] Int. Cl.[3] ..... B08B 9/06

[52] U.S. Cl. ..... 134/22.12; 134/22.15; 134/22.18; 134/117; 134/166 C; 137/240; 137/590; 251/127; 141/5; 141/231

[58] Field of Search ..... 134/22.12, 22.15, 22.18, 134/24, 117, 166 C; 137/240, 590; 251/127; 141/5, 231

[56] References Cited

U.S. PATENT DOCUMENTS

| | | | |
|---|---|---|---|
| 2,639,849 | 5/1953 | Meyer | 141/5 |
| 3,536,081 | 10/1970 | Riess | 134/22.12 |
| 3,728,156 | 4/1973 | Miller | 134/24 |

*Primary Examiner*—Arthur D. Kellogg
*Attorney, Agent, or Firm*—James M. Diemen

[57] ABSTRACT

The invention comprises an injection tank for cleaning boilers and heat exchangers. The tank is pressurized by connection to a potable city water supply. The filling, pressurization and injection of cleaning of treatment materials are carefully controlled by the provision of control and check valves on the inlet and outlet of the tank. An interior perforated tank baffle assures that the treatment materials are fully cleared from the tank during injection and thoroughly mixed with pressurized incoming water. The tank is light and portable without requiring separate powered pressurization means.

6 Claims, 3 Drawing Figures

INJECTION TANK FOR CLEANING BOILERS AND HEAT EXCHANGERS

BACKGROUND OF THE INVENTION

The field of the invention pertains to boilers and heat exchangers and, in particular, to simple and convenient means for injecting cleaning and treatment materials into boilers and heat exchangers.

An example of a device specifically directed to cleaning boilers is disclosed in U.S. Pat. No. 2,530,018 to Marks. The Marks device provides for spraying into a boiler firebox through the closed door with a pipe assembly that accommodates opening and closing of the door. The device does not provide for the admixture of cleaning or treating materials.

Slayter, U.S. Pat. No. 2,747,844, discloses a tank for thoroughly mixing two fluids. Within the tank are a combination of inner tubes and baffles perforated at specific locations to mix portions of one fluid with the other as both flow lengthwise through the tank.

Walker, U.S. Pat. No. 2,599,678, discloses a vertical tank to supply treatment materials to a separate water mixing nozzle for agricultural uses. The tank is pressurized by a water supply that is tightly restricted by an orifice passage into the tank and the water added to the tank to drive out the treatment material is purposely not intended to mix with the treatment material.

Kimmell, U.S. Pat. No. 3,968,932, discloses a large tank and piping system for supplying treatment chemicals to agricultural irrigation water supplies. The horizontal tank includes a length of perforated pipe located adjacent the tank bottom to keep the treatment chemicals in the tank agitated. Mixing of the treatment chemicals with the irrigation water supply is accomplished in an admixing nozzle separate from the tank.

The means currently used by servicemen to clean boilers and heat exchangers utilize a motor driven pump to supply pressurized water to a tank filled with treatment materials. The tanks used with the pumps do not assure that all of the treatment material is discharged into the boiler or heat exchanger. With the associated motor driven pump the current apparatus costs several thousand dollars and is cumbersome for the serviceman to hand carry from a service vehicle to the boiler location. The boiler location may also be very cramped and inconveniently located for hand carrying heavy machinery. To overcome the inconvenience and expense of the means currently used, applicants have invented the injection tank disclosed and claimed below.

SUMMARY OF THE INVENTION

Applicants' injection tank for cleaning boilers and heat exchangers comprises a light portable tank that is pressurized by connection to the city potable water supply usually available at the location of the boiler or heat exchanger. The tank is filled with treatment or cleaning chemicals through a cap thereon having a stop cock for the controlled release of air in the tank as the tank is subsequently pressurized. The tank includes valve means to admit a city water supply thereto without fear of backup of treatment materials into the water supply and separate valve means to supply the mixture of treatment materials and city water to the boiler or heat exchanger.

At the inlet end of the tank a conical perforated baffle is installed to break up the incoming stream of water thereby thoroughly mixing the water with the treatment materials and substantially eliminating dead spots within the tank where treatment materials could collect and remain during injection. Thus, the tank assures that all of the treatment materials are injected into the boiler or heat exchanger and that the injection tank is thoroughly cleared of treatment materials each time it is used. The treatment tank can thereby be used with other chemicals immediately thereafter without fear that improper mixtures of treatment chemicals will occur.

The tank is sized to be conveniently carried by a serviceman or woman from the service vehicle to the boiler location and can be connected to the city water supply with a length of hose. The tank is simply constructed of materials not affected by treatment and cleaning chemicals and can be manufactured and sold for approximately one tenth the cost of the motor and pump driven units currently used.

DESCRIPTION OF THE PREFERRED EMBODIMENT

Figure 1:
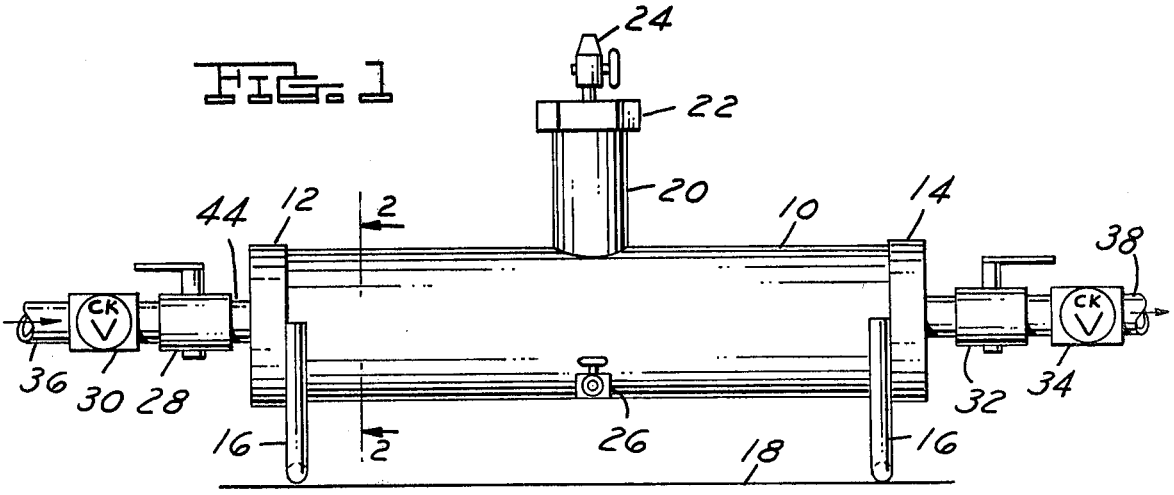
FIG. 1 is a side view of the injection tank and associated valving.
Figure 3:
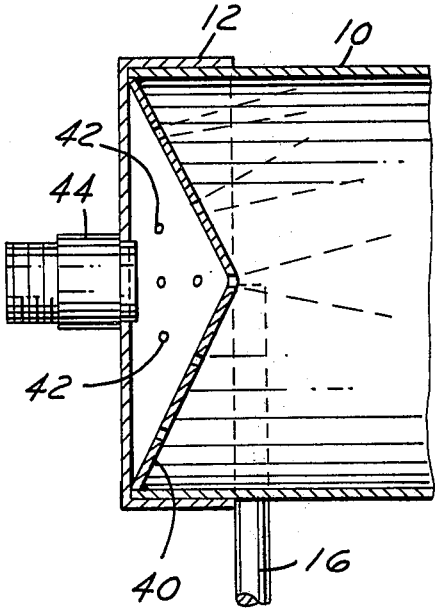
FIG. 3 is a partial section of the tank taken along the line 3—3 of FIG. 2.

Illustrated in FIG. 1 is the cylindrical tank 10 including an inlet end cap 12 and outlet end cap 14 welded or brazed thereto to provide a pressurizeable chamber. U-shaped supports 16 are welded or brazed to either side of the tank 10 at each end to support the device upon a level surface 18 as necessary.

Welded or brazed to the top of the tank 10 is a vertical fill pipe 20 in communication with the tank interior. The fill pipe 20 in turn is equipped with a removable threaded cap 22. A small stop cock 24 is fitted to the cap 22 to provide an adjustable opening between the tank 10 and the environment. A second stop cock 26 extends from the bottom of the tank 10 for drainage of the tank as necessary.

Extending serially from the inlet end cap 12 are an inlet control valve 28 and inlet check valve 30. Extending serially from the outlet end cap 14 are an outlet control valve 32 and outlet check valve 34. The inlet 36 is typically connected to a city water supply or other source of clean water at about city water supply pressure. The oulet 38 is typically connected to the boiler piping or heat exchanger piping to be cleaned or treated.

Brazed or welded inside the inlet end of the tank 10 is a conical baffle 40 having a plurality of holes 42 therethrough. The baffle 40 spreads and breaks up the stream of water that enters the tank from the inlet pipe 44. The baffle 40 thereby substantially eliminates dead spots adjacent the inlet end cap 12 where chemical cleaning agents will otherwise collect and assures that all chemicals in the tank are injected into the boiler or heat exchanger.

The operation of the injection tank is as follows. The outlet 38 is connected to the boiler or heat exchanger and the inlet 36 is connected to the city water supply or a pressurized water supply. Valves 28 and 32 remain shut and cap 22 is opened to permit chemical cleaning materials to be poured into the empty tank 10. The tank 10 may be partially or completely filled with the chemical cleaning materials. The cap 22 is replaced and the stop cock 24 opened to allow air in the tank to escape as the inlet valve 28 is opened to admit city water. The stop cock 22 is then closed with the inlet valve 28 open to pressurize the filled tank. The inlet check valve 30 prevents inadvertent back up into the water supply of chemical cleaning materials and water in the tank.

With the tank pressurized the outlet valve 32 is opened and the mix of chemical cleaning material and water in the tank is flushed into the boiler or heat exchanger. The outlet check valve 34 prevents inadvertent back flow of materials from the boiler or heat exchanger into the tank. The flow of water through the baffle 40 with the valve 32 open provides complete flushing of the tank contents into the boiler or heat exchanger.

A construction suitable for convenient use by boiler servicemen comprises a tank of 18 inches length and of 4 inches inside diameter. The inlet and outlet valves are ¾ inch NPT ball valves and the check valves are ¾ inch NPT spring check valves. The overall length including short pipe lengths and fittings is approximately 29 inches. In an alternative form to shorten the entire assembly, two elbows at each end of the tank may be added between the tank and the valve to form a U-shaped conduit with a valve and check valve located above each end of the tank. In this manner the overall length of the injection tank assembly can be less than 24 inches.

Figure 2:
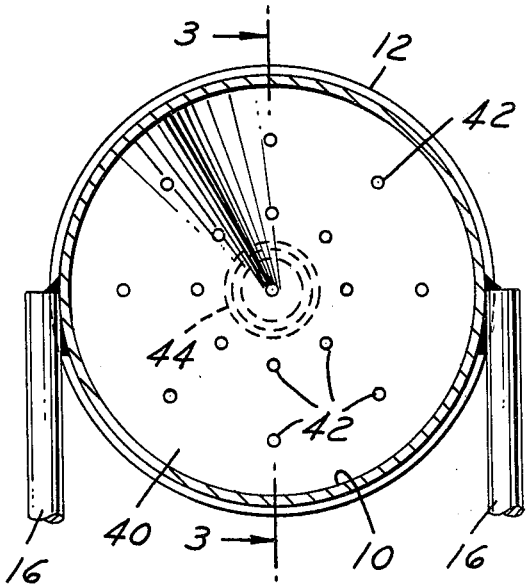
FIG. 2 is a cross section of the tank taken along the line 2—2 of FIG. 1.

The stop cocks are ¼ inch NPT air cocks and the cap a 2 inch NPT brass cap. The tank is constructed of copper pipe and brass fittings with the exception of the baffle which is of stainless steel approximately 1/16 inch in thickness. The baffle holes are 3/16 inch in diameter in the pattern shown in FIG. 2 which has proven adequate for the injection tank size above described, however, a large number of smaller holes or more extensive pattern may be required for very viscous cleaning materials or powdered cleaning materials that do not dissolve readily in water. The injection tank is not limited to the size described above but may be sized larger or smaller depending upon boiler or heat exchanger size. The above example has been found very convenient as a portable device that can be hand carried by one serviceman and attached by hose to any convenient water supply found adjacent to boiler or heat exchanger installations. In addition, the inlet check valve may be replaced by a back flow preventer such as a Watts 9 - D ¾ inch back flow preventer. The back flow preventer dumps any reverse flow from the tank and boiler out of the device to the environment thereby preventing any excessive back pressure in the tank and any back flow into the potable water supply.

We claim:

1. A portable hand carriable hydraulic injection tank for cleaning boilers and heat exchangers comprising a generally cylindrical oblong tank with an inlet end and an outlet end enclosing each end of the cylindrical tank, an inlet valve and inlet check valve serially connected to the inlet end of the tank and adapted for connection to a pressurized water supply, an outlet valve and outlet check valve serially connected to the outlet end of the tank and adapted for connection to a boiler or heat exchanger, a capped fill pipe connected to the tank and a perforated baffle within the tank enclosing substantially the entire inlet end of the tank, said baffle perforated so as to cause a substantially evenly distributed flow of fluid throughout the tank interior as the fluid moves from inlet end to outlet end.

2. The portable hydraulic injection tank of claim 1 including means to release air in the tank as the tank is pressurized by admittance of pressurized water at the inlet end of the tank.

3. The portable hydraulic injection tank of claim 2 wherein the air release means comprises a stop cock mounted on the fill pipe cap.

4. The method of cleaning a boiler or heat exchanger comprising:

(a) adding a quantity of cleaning material to an hydraulic injection tank with the inlet and outlet valves of the tank closed, (b) attaching a source of pressurized water to the inlet of the tank and attaching the outlet of the tank to the boiler or heat exchanger, (c) admitting pressurized water to the tank through the inlet valve while simultaneously releasing air from the tank through an air relief stop cock, (d) closing the air relief stop cock to pressurize the tank, and, (e) opening the outlet valve to flush the water and cleaning material mixture into the boiler or heat exchanger.

5. The method of claim 4 wherein the inlet valve remains open at least until the tank is completely flushed of cleaning material mixture.

6. The method of claim 4 wherein chemical treatment materials are added to the tank in step (a).

* * * * *